US006279562B1

(12) United States Patent
Clayton

(10) Patent No.: US 6,279,562 B1
(45) Date of Patent: Aug. 28, 2001

(54) TOY GUN WITH MULTIPLE DISCHARGE PORTS

(76) Inventor: Richard A. Clayton, 71 Humboldt St., Simi Valley, CA (US) 93065

( * ) Notice: Subject to any disclaimer, the term of this patent is extended or adjusted under 35 U.S.C. 154(b) by 0 days.

(21) Appl. No.: 09/020,819

(22) Filed: Feb. 9, 1998

(51) Int. Cl.[7] ..... F41B 11/00
(52) U.S. Cl. ..... 124/59; 124/72; 222/79
(58) Field of Search ..... 124/59, 72, 69, 124/73; 222/79

(56) References Cited

U.S. PATENT DOCUMENTS 5,373,832 * 12/1994 D'Andrade ..... 124/59
5,797,385 * 8/1998 Thai ..... 124/59
5,878,734 * 3/1999 Johnson et al. ..... 129/59

* cited by examiner

*Primary Examiner*—J. Woodrow Eldred

(57) ABSTRACT

A toy gun projects matter from a plurality of discharge ports, such as barrels or nozzles, which are irregularly located on the gun. The gun may incorporate a figurine in its structure to simulate an object such as a creature or a vehicle. The discharge ports may simulate a plurality of weapons carried by or on the figurine, such as cannons, machine guns, lasers or the like and may be adapted to project matter in solid or liquid forms, such as darts or water. A pump mechanism pressurizes gas or liquid, typically air or water, to facilitate the discharge of such projected matter. A distribution mechanism conducts the pressurized gas or liquid to the discharge ports.

34 Claims, 9 Drawing Sheets

TOY GUN WITH MULTIPLE DISCHARGE PORTS

BACKGROUND OF THE INVENTION

The invention relates generally to toy guns and projectile launchers, and more particularly to such devices which incorporate a figurine into the structure of the device to simulate a vehicle, creature or other figure, and to such devices adapted to discharge water or other projectiles from multiple ports.

Dart guns are known in the art in which the body of the gun is in the form of an aircraft. In such guns a dart barrel is typically formed in the nose of the aircraft fuselage. A handle at the rear of the fuselage allows the user to draw back the plunger of an internally carried air pump. A pistol grip and trigger attached to the underside of the fuselage allow the user to hold and discharge the toy. The toy is identical in function and manner of operation to a typical single shot dart gun, except that its body is shaped like an aircraft rather than a gun.

Also known in the art are water guns concealed in, disguised as, or otherwise incorporating figurines. Examples are found in U.S. Pat. No. 5,667,419 (Spector), U.S. Pat. No. 5,318,202 (D'Andrade), U.S. Pat. No. 5,305,918 (D'Andrade), U.S. Pat. No. 4,703,892 (Nadel), and U.S. Pat. No. 4,630,756 (Amici et al.).

A common characteristic of the above referenced dart guns and water guns is they are limited to discharging projectile matter from a single discharge port.

Also known in the art are air operated projectile launchers, such as dart guns, which are capable of launching projectiles sequentially from multiple discharge ports. Typically this involves the use of a multiple barrel magazine which can be rotated or otherwise moved on the frame of the gun to sequentially align the individual barrels with the air outlet of an air pump. For the purpose of such alignment with the barrels, the air pump outlet is fixed in position on the gun frame. Examples of this structure are found in U.S. Pat. No. 2,237,678 (Lohr et al.). A variation on this structure is disclosed in U.S. Pat. No. 5,535,729 (Griffin et al.) wherein a magazine is held in a stationary position on the frame of a dart gun, and an air pump is rotated to sequentially align an air outlet with the barrels of the magazine.

A common characteristic of such multi-shot devices is the grouping of the barrels in a uniform pattern, immediately adjacent one another, in a magazine which is movably or releasably attached to the body. Commonly used magazine patterns include evenly spaced circular and linear arrays of barrels. Such arrangements are necessary in prior art devices to allow movable barrels to sequentially align with a stationary air outlet, or vice versa, through simple incremental motions. Another common characteristic of such devices is the proximity of the barrels to the air pump. Pumps and barrels in these and other multi-shot air guns are aligned and positioned adjacent to one another because it is efficient, both as to layout and construction of the gun and as to delivery of air from pump to barrel. Adherence to such conventions and the incorporation of such characteristics has limited prior art development of multiple barrel, air powered toy guns to generally conventional layouts, e.g., a magazine comprising a circular or linear array of barrels carried at the front end of a gun in direct contact with the cylinder of an air pump.

SUMMARY OF THE INVENTION

Accordingly, the present invention provides novel constructions for toy guns wherein a pump or other pressurization mechanism is employed to project matter from a plurality of projectile discharge ports at locations generally remote from the pressurization mechanism, remote from one another, or otherwise irregularly positioned. The invention further provides novel constructions for toy guns wherein a plurality of projectile discharge ports, such as barrels or nozzles, simulate a plurality of weapons or the like being operated by or upon a figurine or model. For example, the invention can be employed to construct toys simulating such things as a multi-headed serpent that spits liquid from each head, a robot that fires a plurality of guns or other simulated weapons, and a vehicle (aircraft, water craft, army tank, spacecraft, etc.) that launches projectiles from a plurality of simulated cannons.

In general, the invention includes distribution mechanisms for directing pressurized matter, typically air or water, from a central pressure source, such as a pump, to remote locations on a gun. The invention may be employed in air guns, wherein the pressurized matter, air, is used as a propellant to discharge solid projectiles such as darts. The invention may also be employed in water guns wherein the pressurized matter, water, is itself utilized as a projectile. In either example, the invention allows a single pump at one location on the gun to discharge projectile matter from a plurality of locations remote from each other and/or from the pump. A typical embodiment includes the incorporation of a figurine into the frame or body of the gun, wherein primary components of the pump and associated pressure distribution mechanisms are concealed within a relatively large central portion of the body, and a plurality of barrels, nozzles or other discharge ports are carried upon extremities characteristic of the particular figurine incorporated. Other embodiments may comprise a pump on one part of a gun, a plurality of barrels on a remote subassembly of the gun, and a plurality of flexible conduits connecting the individual barrels to a selective distribution mechanism for delivering pressurized air sequentially to one barrel at a time.

It is therefore a primary objective of the present invention to enable the construction of pressure operated toy guns in a variety of novel configurations wherein extra play value is derived by the separation of multiple discharge ports from a common pressurization mechanism.

It is a further objective of the invention to enable the construction of novel toy guns wherein multiple projectiles appear to be discharged from or by a creature, vehicle or other object that can be simulated by a figurine incorporated into the toy.

BRIEF DESCRIPTION OF THE DRAWINGS

The present invention, both as to its organization and manner of operation, together with further objects and advantages thereof, may best be understood with reference to the following description, taken in conjunction with the accompanying drawings in which.

DESCRIPTION OF EXEMPLARY EMBODIMENTS

Figure 1:
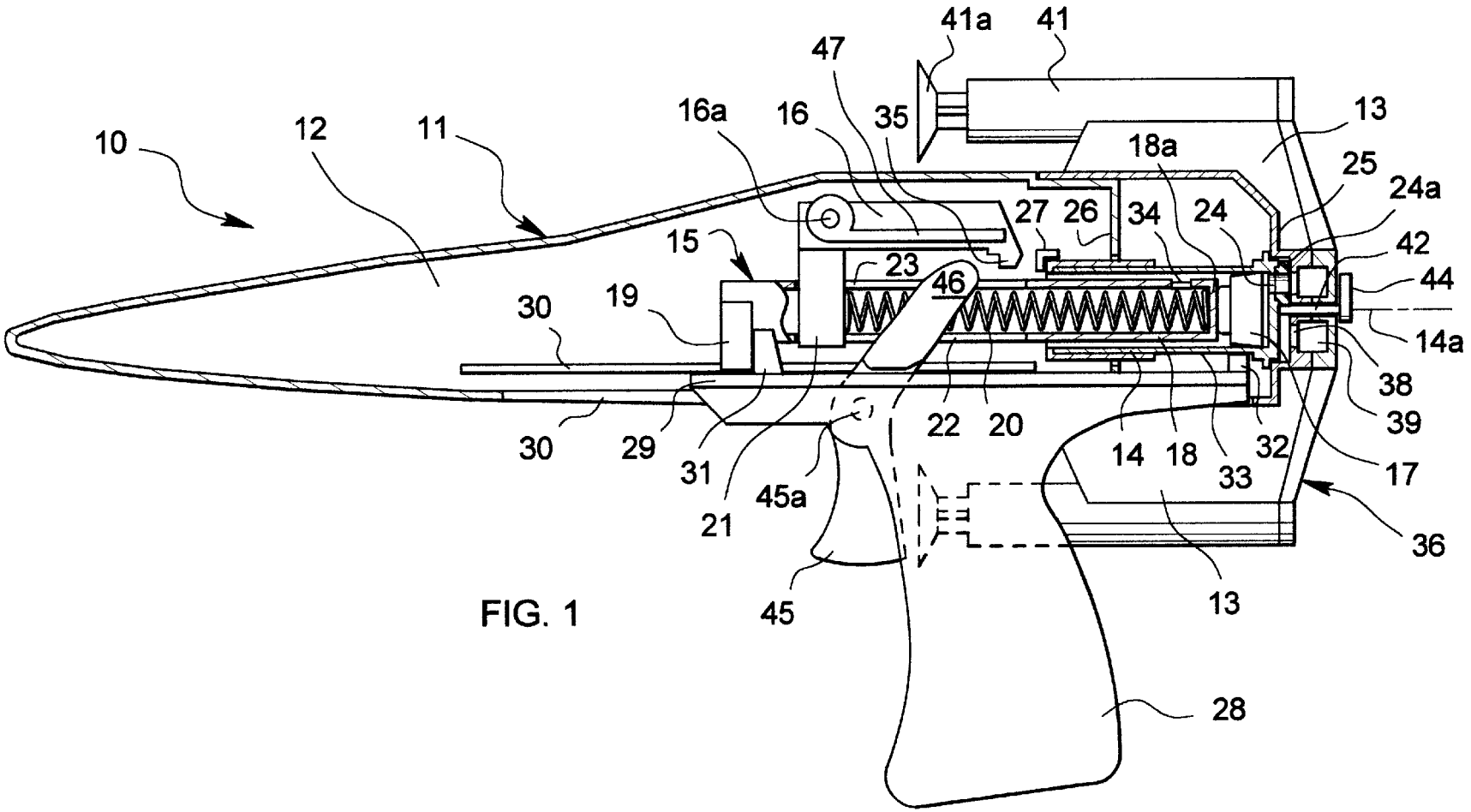
FIG. 1 is a side view, partially in section, of a novel dart gun incorporating the invention.
Figure 2:
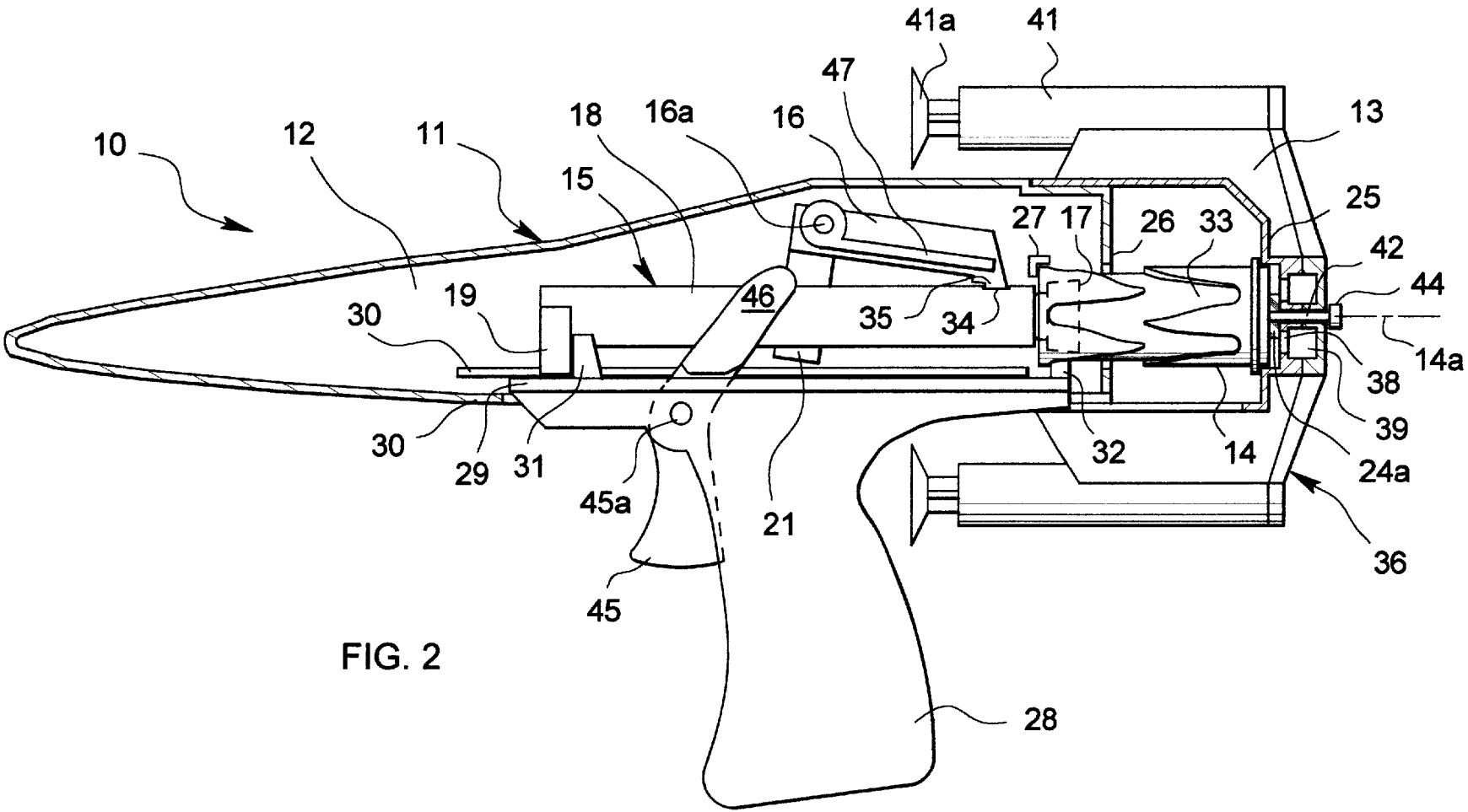
FIG. 2 is a side view, partially in section, of the dart gun of FIG. 1 wherein an operating handle is halfway through an operative cycle.
Figure 3:
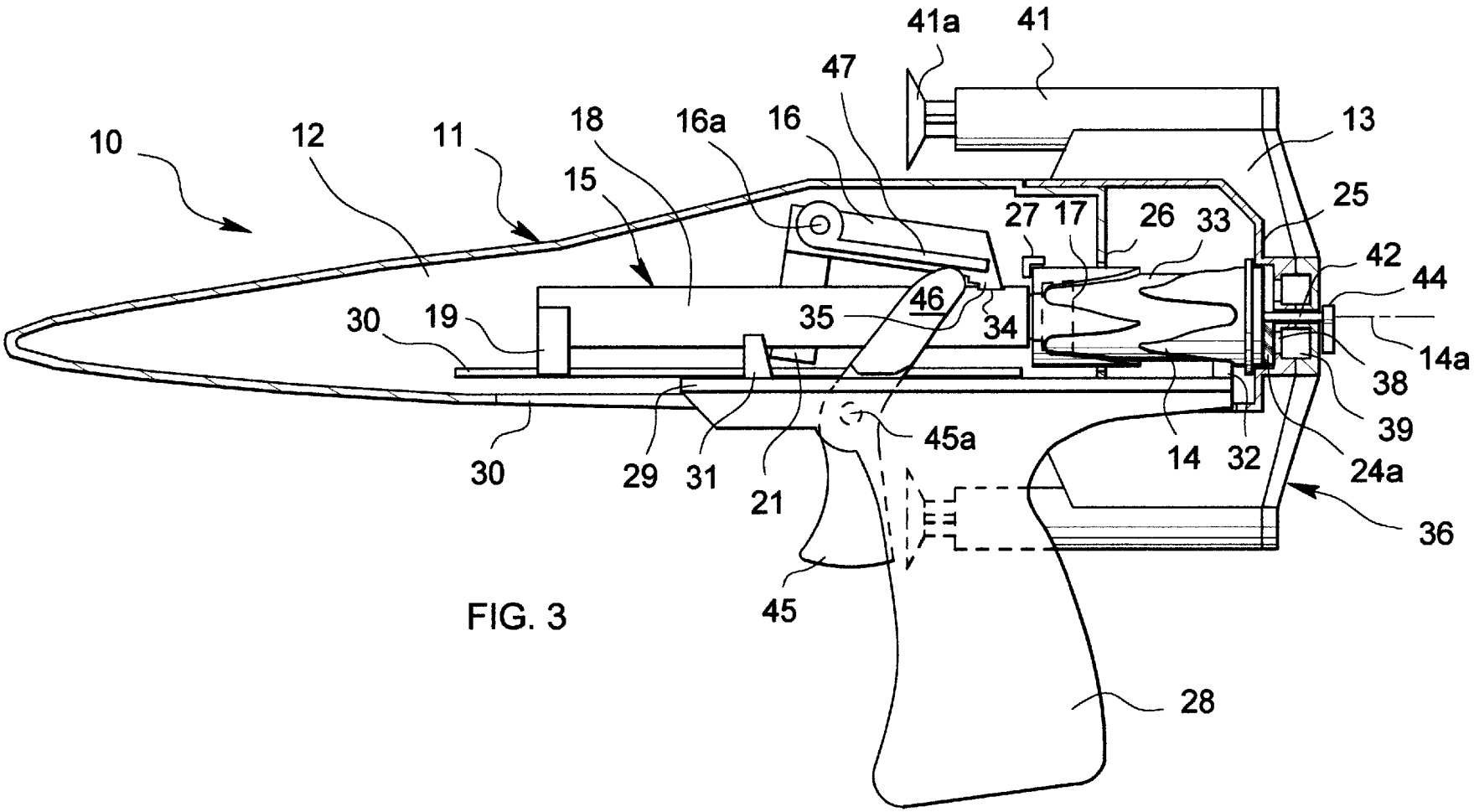
FIG. 3 is a side view, partially in section, of the dart gun of FIG. 2 wherein the operative cycle of the operating handle is complete and the gun is ready to be discharged.

FIGS. 1, 2, and 3 depict, by way of illustration but not of limitation, a dart gun employing the present invention. The dart gun, indicated in the general direction of arrow 10, includes a body or frame 11 that simulates a flying vehicle having a fuselage portion 12 and four wings 13. Carried within the fuselage 12 are a cylinder 14, a plunger 15 and a latch 16. The plunger comprises a piston 17, and a hollow shaft 18 having a protruding shoulder 19. A spring 20 is carried within the plunger shaft 18 such that one end of the spring rests against the end 18*a* of shaft 18 nearest the piston 17, and the other end of the spring rests against a member 21 of the latch 16 which protrudes into the interior of the shaft 18 through a pair of slots 22, 23. The plunger 15 is carried for forward and reverse travel within the fuselage 12 such that piston 17 either draws air into cylinder 14 or compresses air within the cylinder, depending on direction of travel. The cylinder 14 includes an outlet 24 for discharging air compressed by the piston 17. The outlet 24 is offset from a central longitudinal axis 14*a* of cylinder 14. The cylinder 14 is movably carried for rotation about the axis 14*a*. Frame members 25, 26 and 27 support the cylinder 14.

A "pistol grip" styled handle assembly 28 is carried for travel between a forward position and a rearward position on the frame 11. To this end, rails 29 of the handle assembly 28 slide within guides 30 of the frame 11. A finger 31 of the handle assembly 28 engages shoulder 19 of the plunger 15, and a shaft 32 on the handle assembly 28 engages a set of grooves 33 on the cylinder 14. As depicted in FIG. 1, the firing mechanism of the gun (which includes cylinder 14, plunger 15, latch 16 and spring 20) is in a discharged condition. If the handle assembly 28 is moved forward on the frame 11 (ref. FIG. 2), engagement of finger 31 with shoulder 19 causes the plunger 15 to be moved forward, compressing spring 20 between the end 18*a* of the plunger shaft and member 21 of the latch. The spring tension applied to member 21 urges latch 16 to pivot in the clockwise direction about its mounting shaft 16*a*. At the same time, cam action between shaft 32 and grooves 33 forces cylinder 14 to rotate about its axis 14*a* in order to keep a groove 33 in alignment with shaft 32 as the shaft moves forward with the handle assembly 28.

When the handle assembly reaches the position shown in FIG. 2, an opening 34 in one side of plunger shaft 18 becomes aligned with a hook 35 on latch 16. Rotation of the latch (by tension of spring 20) forces the hook into the opening, thereby latching the plunger 15 in this position. The cam mechanism of shaft 32 and grooves 33 is designed such that travel of the handle assembly 28 to this position causes cylinder 14 to rotate by approximately one eighth of a revolution. As the handle assembly is returned to its rearward position (ref. FIG. 3), the plunger 15 remains in the latched position and the cylinder 14 is rotated another one eighth revolution. Since the cylinder outlet 24 is offset from the axis of rotation, it is swept through a ninety degree arc by the forward and reverse cycle of travel described above for handle assembly 28.

Figure 4:
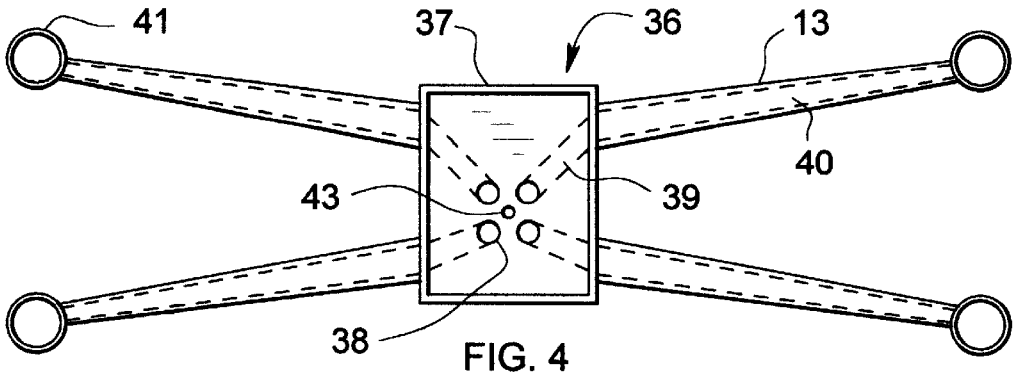
FIG. 4 is a front view of a subassembly, including wings and projectile launching barrels, of the dart gun of FIGS. 1, 2 & 3.
Figure 5:
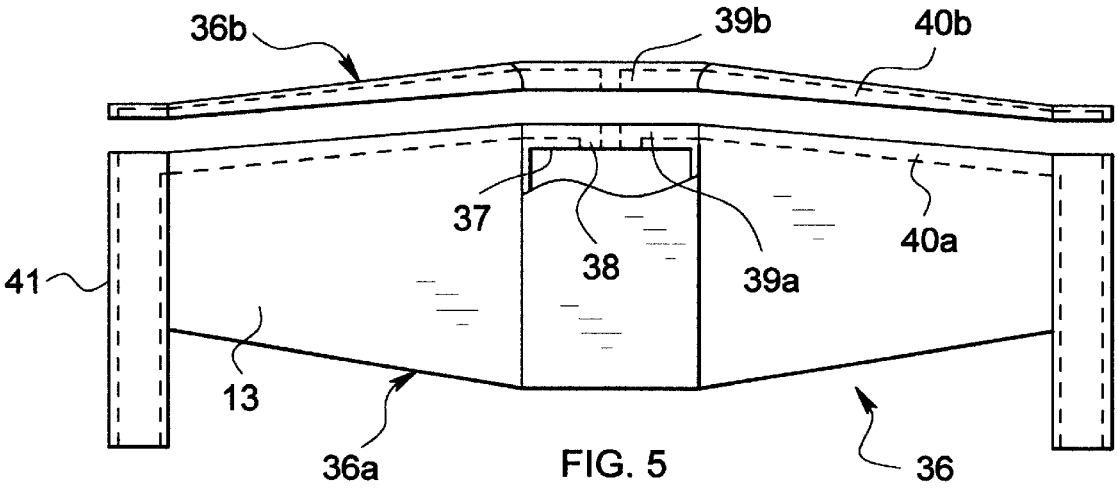
FIG. 5 is a top view, partially exploded, of the dart gun subassembly of FIG. 4.
Figure 6:
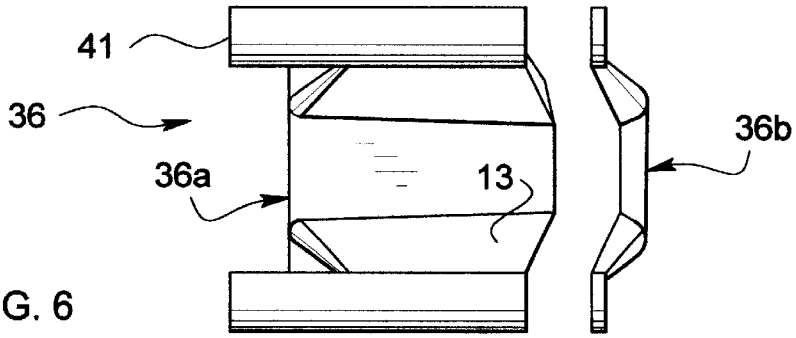
FIG. 6 is a side view, partially exploded, of the dart gun subassembly of FIGS. 4 & 5.

As illustrated in FIG. 4, 5 and 6, the wings 13 are attached to a subassembly 36 of frame 11. Subassembly 36 includes a central portion 37 having four holes 38 opening into four passages 39. The passages 39 are formed in the rear side of the structure and are therefore represented in dashed lines. Each of the passages 39 extends toward a different corner of the central portion 37 of subassembly 36, each corner corresponding to the general location of one of the four wings 13. Each passage 39 joins a similar passage 40 which traverses the rear edge of a wing. At the tip of each wing is a projectile discharge port in the form of a hollow, tubular dart barrel 41, open at its front and in communication with a passage 40 at its rear. The four holes 38 are spaced at ninety degree intervals about axis 14*a*, offset from the axis by the same distance as cylinder outlet 24, and are oriented such that the outlet 24 will be aligned with a selected one of the four holes whenever handle assembly 28 is in the rearward position as in FIGS. 1 and 3. Thus, as the handle assembly is repeatedly cycled the outlet will sequentially step through alignment with each of the holes 38. A gasket 24*a* is affixed to the cylinder 14 about outlet 24 to prevent pressurized air from escaping at the union of outlet 24 and a hole 38. A shaft 42 on the cylinder 14 extends rearward to the exterior of the body 11 via a hole 43 in frame subassembly 36. The hole 43 is in alignment with axis 14*a* about which the cylinder 14 rotates. A dial 44 is attached to the shaft 42 in alignment with the air outlet 24, and rotates with cylinder 14 to indicate which barrel 41 is ready to be discharged. With reference to FIG. 5 it may be observed that the frame subassembly 36 comprises a main section 36*a* which includes the wings 13 and barrels 41, and a rear cover section 36*b*. The air passages 39, 40 are formed from channels 39*a* and 40*a* which are molded into the main section 36*a*, and channels 39*b* and 40*b* which are molded into the rear cover section 36*b*.

With the plunger 15 latched in its forward position and the handle assembly 28 in its rearward position (ref. FIG. 3), the dart gun 10 is cocked and ready to fire. To discharge a dart 41*a* from a barrel 41, an operator presses a trigger 45 carried on handle assembly 28. The trigger pivots about a shaft 45*a* such that members 46 of the trigger 45 engage flanges 47 on the latch 16 to force hook 35 upward and out of opening 34 to release the plunger 15. Spring 20 drives the plunger 15 rapidly into cylinder 14 to compress air therein. Pressurized air is forced from the cylinder through outlet 24, into an aligned hole 38, through an associated passage 39, 40 and into the rear of a barrel 41 to eject a dart 41*a* therefrom. A user can recycle the handle 28 and trigger 45 repeatedly to discharge all barrels 41 in automatic sequence.

Figure 7:
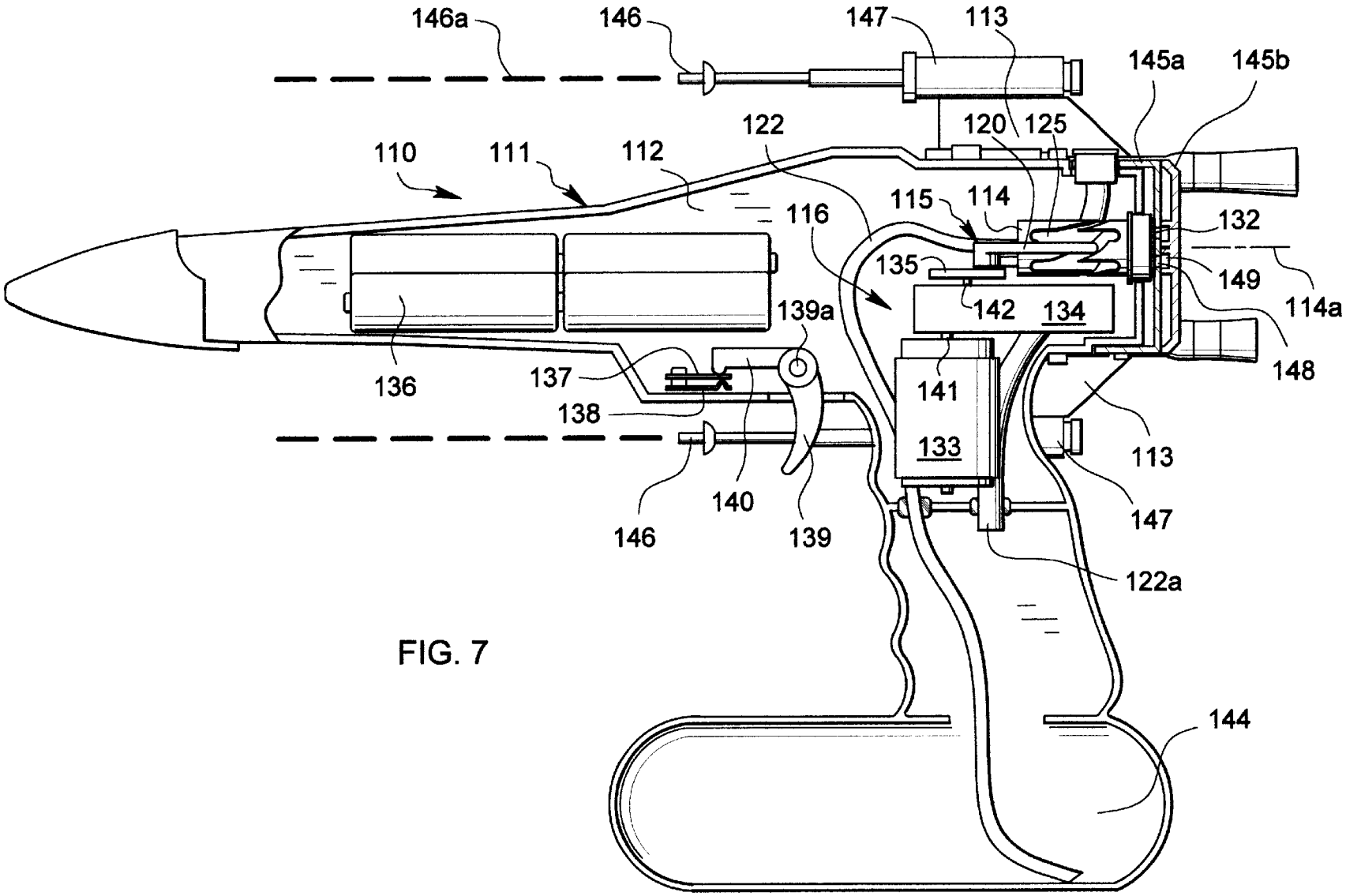
FIG. 7 is a side view, partially in section, of a novel water gun incorporating the invention.
Figure 8:
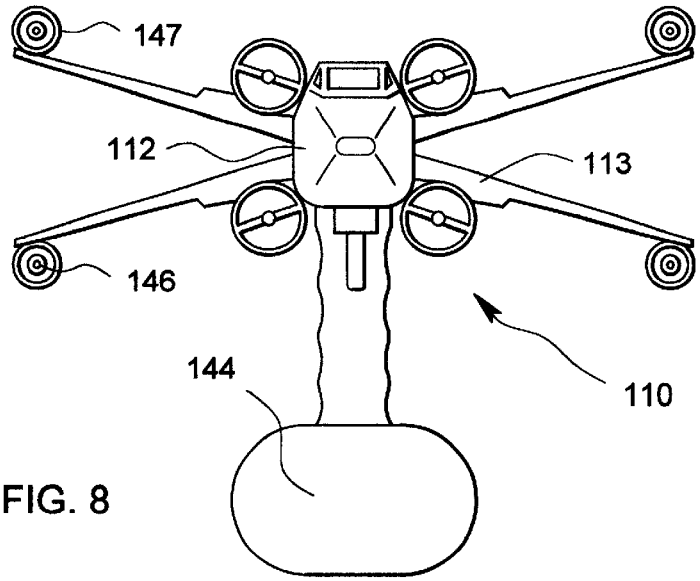
FIG. 8 is a front view of the water gun of FIG. 7.
Figure 9:
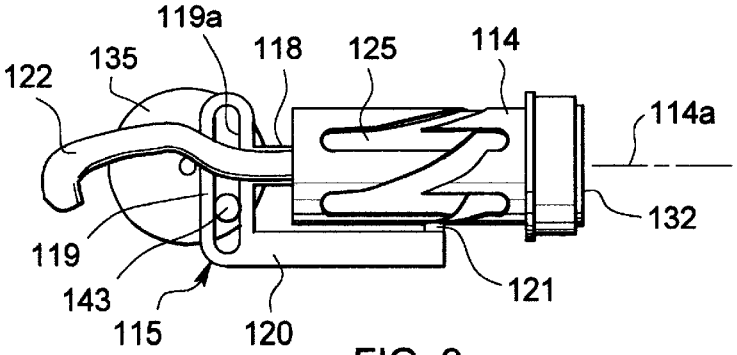
FIG. 9 is a top view of pump and sequencing mechanisms of the water gun of FIG. 7.
Figure 10:
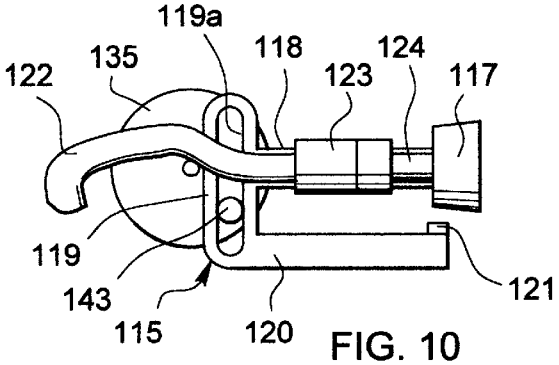
FIG. 10 is a top view of components of the pump and sequencing mechanisms of FIG. 9.

FIGS. 7 and 8 depict a water gun constructed in accordance with the present invention. The water gun, generally indicated by numeral 110 includes a a body or frame 111 that simulates a flying vehicle having a fuselage portion 112 and four wings 113. Carried within the fuselage 112 are a cylinder 114, a plunger 115 and a motor assembly 116. With reference to FIGS. 9 and 10, the plunger comprises a piston 117, a shaft 118 attached to a slotted member 119, and a cylinder advancement arm 120 also attached to the slotted member 119. The advancement arm carries a cam finger 121. A flexible water supply tube 122 is connected to the input side of a unidirectional check valve 123 carried on shaft 118. The output side of valve 123 feeds through the piston 117 via a tube 124. A fill tube 122*a* provides for filling of a reservoir 144.

Figure 12:
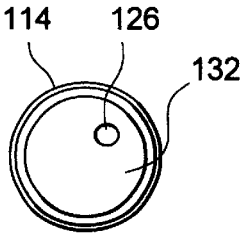
FIG. 12 is an end view of the cylinder of FIGS. 9 and 11.
Figure 11:
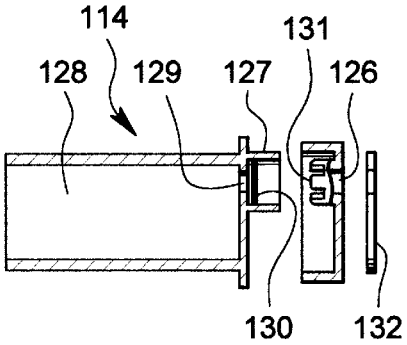
FIG. 11 is an exploded side sectional view of a cylinder and valve assembly of the pump mechanism of FIG. 9.

The cylinder 114 is movably carried for rotation about a central longitudinal axis 114*a*. The cam finger 121 engages surfaces in a set of indexing grooves 125 on the cylinder 114. These are similar to grooves 33 on cylinder 14 in the dart gun 10 of FIG. 1, except that on cylinder 114 of water gun 110 the grooves 125 are configured to rotate the cylinder by ninety degrees on an intake stroke of the plunger 115 and to cause no rotation on a discharge stroke. In this way the cylinder outlet 126 (ref. FIGS. 11 and 12) rotates incrementally as the pump 114, 115 is filled with water and remains stationary as the pump is discharged.

The cylinder 114 incorporates an check valve 127 to prevent reverse flow of water from outlet 126 into the cylinder's interior chamber 128. The check valve 127 includes an orifice 129 in communication with chamber 128, a disk 130, and a disk retaining structure 131. The retainer 131 allows some movement of the disk 130 from side to side in FIG. 11, so that pressurized water is able to flow from orifice 129 to outlet 126. Suction created on an intake stroke of plunger 115 pulls disk 130 against the orifice 129 to prevent reverse flow. A gasket 132 is provided to ensure a good seal between outlet 126 and a water distribution mechanism which will be described further herein.

The motor assembly 116 provides drive force for operation of the pump mechanism, which includes cylinder 114 and piston 117, and for the sequencing mechanism, which includes arm 120 and grooves 125. Referring to FIG. 7, the motor assembly 116 includes a motor 133, a speed reducing gearbox 134, and a cam wheel 135. Electrical power is supplied to motor 133 from batteries 136 through contacts 137, 138. For simplicity, electrical wiring is not shown in the figure. A trigger 139 is carried for pivoting motion about a shaft 139*a*. When the trigger 139 is operatively pivoted a member 140 of the trigger forces the contacts 137, 138 together to complete the circuit and energize motor 133. Gearbox 134 receives the output of motor 133 via a shaft 141 and, via an internal gear train, adjusts speed and torque as appropriate for application to cam wheel 135 via a shaft 142. The cam wheel 135 includes a lobe 143 (ref. FIGS. 9 and 10) which engages slotted member 119 to reciprocatively drive the plunger 115 along axis 114*a*. Lateral motion of the lobe 143 is lost in slot 119*a*. As the plunger 115 travels right to left in FIGS. 7, 9 and 10, water is drawn into chamber 128 from reservoir 144 through flexible tube 122, intake valve 123, and piston 117. At the same time, cam finger 121 engages surfaces of grooves 125 and forces the cylinder 114 to incrementally rotate ninety degrees about axis 114*a*. As the plunger 115 travels from left to right in the figures, the cylinder remains motionless and water is forced from chamber 128 through outlet valve 127 and outlet 126 (ref. FIG. 11).

Figure 13:
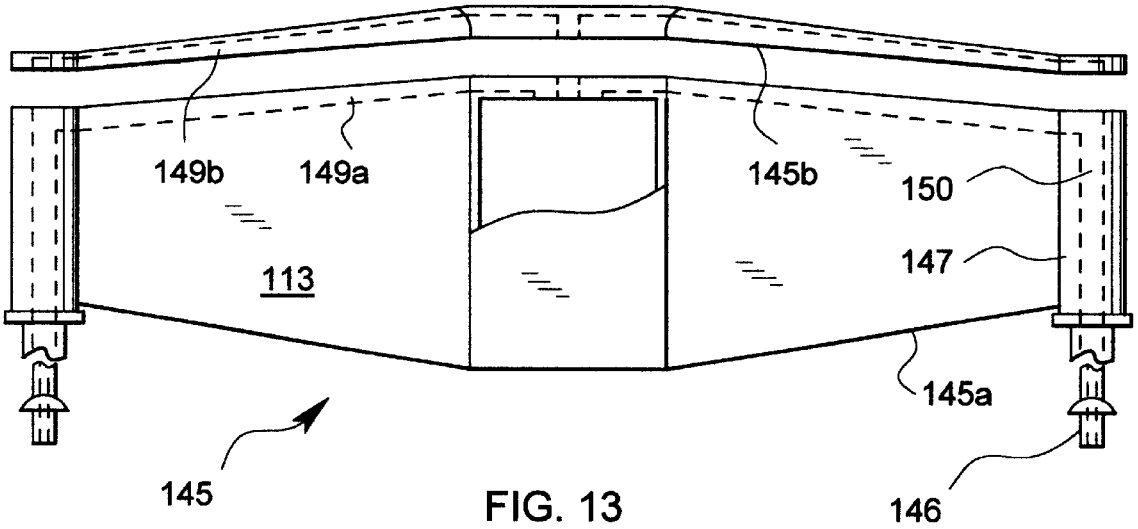
FIG. 13 is a top view, partially exploded, of a subassembly, including wings and nozzles, of the water gun of FIGS. 7 and 8.
Figure 14:
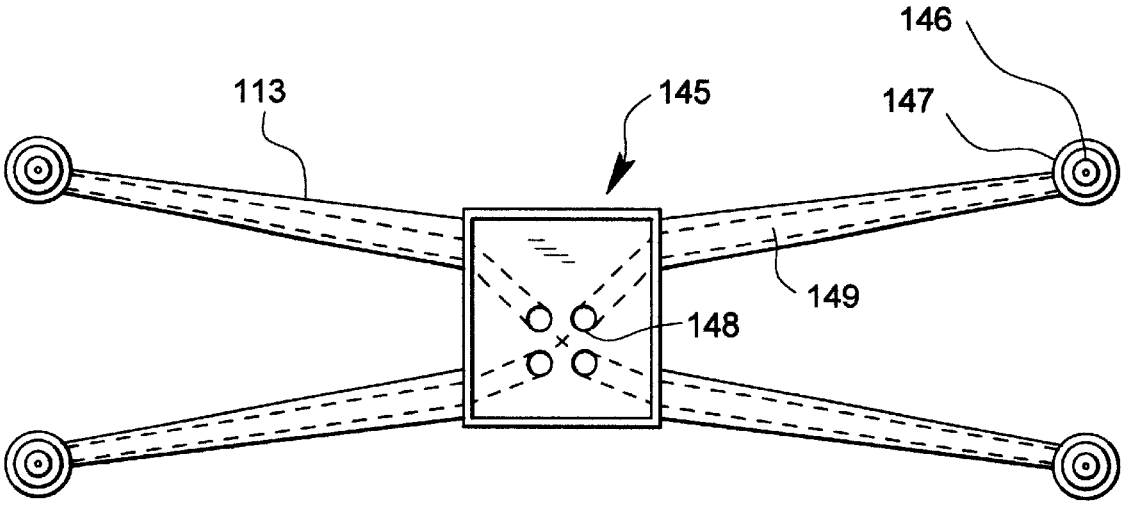
FIG. 14 is a front view of the water gun subassembly of FIG. 13.

With reference to FIGS. 13 and 14 it may be seen that the wings 113 are attached to a subassembly 145 of the frame 111. This subassembly is similar to frame subassembly 36 of the dart gun 10 (ref. FIGS. 4, 5 and 6) except that nozzles 146 are incorporated into simulated weaponry 147 to adapt the gun 110 for discharging streams of liquid 146*a*. The subassembly 145 includes four holes 148 and passages 149 connecting the holes to nozzles 146 via additional passages 150 in the simulated weapons 147. The passages 149 are formed from mating channels 149*a* and 149*b* in two parts 145*a* and 145*b* of subassembly 145. The passages 149, 150 serve as conduits in a mechanism adapted for selectively and sequentially distributing pressurized water from the pump 114, 117 to the four wing-tip nozzles 146. The holes 148 are positioned such that when subassembly 145 is joined to the fuselage 112 the cylinder outlet 126 will become aligned with a different one of the holes, in sequence, each time the cylinder 114 is incrementally rotated by the sequencing mechanism of cam finger 121 and indexing grooves 125 in preparation for discharge of water from the chamber 128. Gasket 132 generally prevents leakage around the connection between outlet 126 and a selected hole 148, and additionally covers the nonselected holes 148 to prevent water from draining out of the conduit passages 149, 150.

Figure 15:
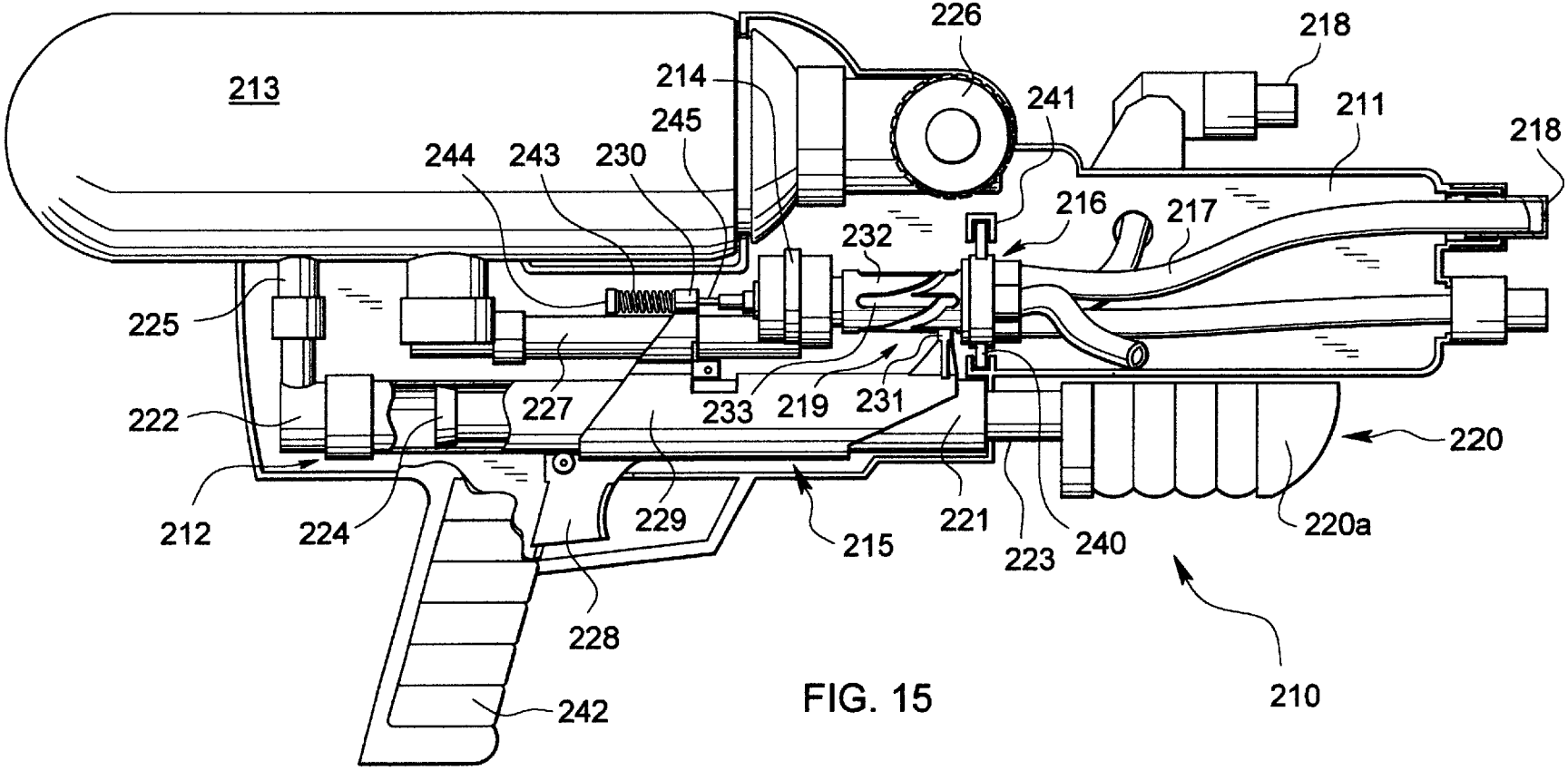
FIG. 15 is a side view in partial section of a novel water gun incorporating the invention.
Figure 16:
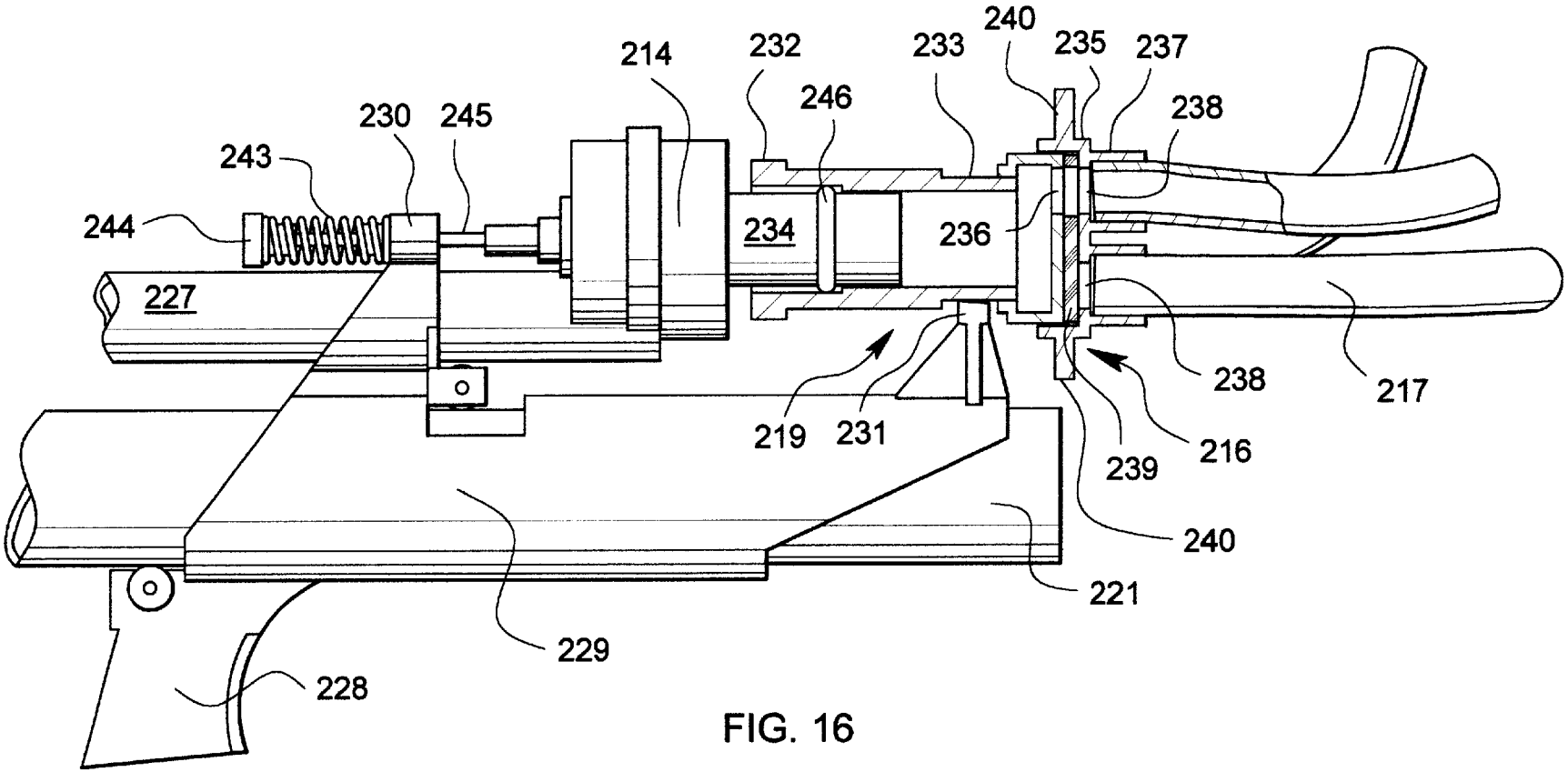
FIG. 16 is an enlarged side view in partial section of mechanisms of the water gun of FIG. 15.

FIGS. 15 and 16 illustrate the invention as embodied in a water gun 210 having a frame 211, a pump mechanism 212 adapted for pressurizing water and air in a sealed reservoir 213, a valve 214 for releasing pressurized water from the reservoir, a trigger assembly 215 for operating the valve, a distribution mechanism 216 for conducting water from the valve 214 to a selected one of four selectable conduits 217, a plurality of nozzles 218 connected to the conduits to receive pressurized water therefrom for discharge from the gun 210, and a sequencing mechanism 219 causing water to be discharged from different nozzles, in a preset sequence, for each actuation of the trigger assembly 215.

The pump mechanism 212 includes a plunger 220, a cylinder 221, and a unidirectional check valve 222. The plunger includes a shaft 223 having a piston 224 at one end and a user operable handle 220*a* at the opposite end. The piston is carried for bi-directional travel within the cylinder to draw outside air into the cylinder when moved in one direction and to pressurize and force air from the cylinder through check valve 222 to the interior chamber of reservoir 213 via a tube 225 when moved in the other direction. Water is added to the reservoir (when not pressurized) through an air tight, removable cap 226. Air pressure urges water from the reservoir 213 into a tube 227 in communication with the water release valve 214. The trigger assembly 215 includes a finger operated trigger 228, a tubular sleeve 229 which slides in forward and reverse directions about cylinder 221, a valve actuating member 230, and a discharge sequencing member 231 which co-acts with other elements of the sequencing mechanism 219. The sequencing mechanism also includes a cylinder 232, movably carried for rotation about a central longitudinal axis of the cylinder. Indexing grooves 233 engage sequencing member 231 in a cam relationship whereby operative travel of the trigger assembly 215 induces rotation of the cylinder 232 in increments of ninety degrees per full cycle of the trigger. One end of the cylinder is carried coaxially about a tube 234 which conducts water released from valve 214. The opposite end of the cylinder 232 is supported upon a manifold 235 of the distribution mechanism 216. The manifold 235 is adapted to position an end of each of the conduits 217 for sequential alignment with an outlet 236 of the cylinder 232 as the cylinder is stepwise rotated through successive ninety degree increments by the sequencing mechanism 219. The remaining end of each conduit is connected to a nozzle 218. The manifold 235 includes four receptacles 237, to which the four conduits 217 are individually mated, and four orifices 238, one per receptacle, to allow communication between the cylinder outlet 236 and a selected conduit 217. A feed through gasket 239 is affixed to the outlet end of cylinder 232 to prevent leakage about the union of outlet 236 and a selected orifice 238, and to prevent drainage of water from nonselected conduits 217 and orifices 238. The manifold 235 is held in a fixed position by engagement of flanges 240 in receptacles 241 of the frame 211.

To prepare the water gun 210 for discharge a user seals water in reservoir 213 and then reciprocates plunger 223 several times to build air pressure within the reservoir. When the trigger assembly 215 is subsequently moved in the direction of pistol grip handle 242 (by a user depressing trigger 228), the valve actuating member 230 begins to compress a spring 243 against a flange 244 at the end of a valve control rod 245. As the spring compresses, sequencing member 231 engages grooves 233 to rotate cylinder 232 by one increment of ninety degrees, thus stepping outlet 236 from alignment with one orifice 238 and into alignment with the next orifice in sequence. As the trigger assembly 215 approaches its rearmost position, spring 243 reaches full compression and the force of member 230 pulls control rod 245 rearward to open valve 214. Water flows through the valve, through tube 234, and into cylinder 232. An o-ring 246 seals the connection between tube 234 and cylinder 232, so the pressurized water must flow through outlet 236, through the currently selected orifice 238 of manifold 235, and through an associated conduit 217. Water in the conduit is applied to an associated nozzle 218, from which it is discharged in a high velocity stream.

What is claimed is:

1. A toy gun comprising a pump mechanism, a distribution mechanism, a sequencing mechanism, an operating mechanism, and a plurality of non-movable discharge ports adapted for projection of matter from said gun;

said discharge ports being fixed in position on said gun at locations that are remote with respect to said pump mechanism;

said pump mechanism adapted to pressurize matter;

said distribution mechanism adapted to receive pressurized matter and to selectively apply said matter to said remotely located discharge ports for discharge of said matter therefrom;

said sequencing mechanism controlling said distribution mechanism for selection of said discharge ports in a predetermined sequence;

said operating mechanism adapted to actuate said sequencing mechanism and to precipitate the flow of pressurized matter to said distribution mechanism;

said sequencing and distribution mechanisms including an indexed element movably carried for rotation about an axis and a drive element adapted to incrementally rotate said indexed element;

said indexed element adapted to conduct a flow of pressurized matter, and including an outlet for said matter, said outlet being radially offset from said axis;

said drive element cooperating with said operating mechanism such that actuation of said operating mechanism causes said drive element to incrementally rotate said indexed element.

2. The invention of claim 1 wherein repetitive incremental rotation of said indexed element causes said outlet to sequentially redirect said matter for successive expulsion from sequential discharge ports of said toy gun.

3. The invention of claim 2 wherein:

said distribution mechanism includes a plurality of conduits, said conduits adapted to sequentially receive pressurized matter from said outlet as said outlet is stepped through said incremental rotation;

sequential conduits of said distribution mechanism being adapted to conduct pressurized matter to sequential discharge ports of said toy gun.

4. A toy gun comprising a pump mechanism, a distribution mechanism, a sequencing mechanism, and a plurality of non-movable discharge ports adapted for protection of matter from said gun;

said discharge ports being fixed in position on said gun at locations that are remote with respect to said pump mechanism;

said pump mechanism adapted to pressurize matter;

said distribution mechanism adapted to receive pressurized matter and to selectively apply said matter to said remotely located discharge ports for discharge of said matter therefrom;

said sequencing mechanism controlling said distribution mechanism for selection of said discharge ports in a predetermined sequence;

an operational cycle associated with said pump mechanism for pressurization of matter thereby;

said sequencing mechanism being responsive to operation of said pump mechanism to incrementally advance said distribution mechanism through said predetermined sequence of discharge port selection, such that a full operational cycle of said pump mechanism results in said distribution mechanism being advanced by one increment in said predetermined sequence of discharge port selection, and such that multiple operational cycles of said pump mechanism are necessary to advance said distribution mechanism through the entirety of said predetermined sequence of discharge port selection.

5. The invention of claim 4 wherein said distribution mechanism includes a plurality of conduits adapted to receive and conduct a flow of pressurized matter, each of said conduits adapted to conduct said matter to a different one of said discharge ports.

6. The invention of claim 4 wherein said toy gun includes a frame;

said frame incorporating a figurine;

said projectile discharge ports being located on said figurine.

7. The invention of claim 6 wherein said figurine simulates a vehicle.

8. The invention of claim 7 wherein said figurine simulates a flying vehicle having a plurality of wings, each of said wings carrying at least one of said discharge ports.

9. The invention of claim 4 wherein said discharge ports are positioned at remote locations with respect to one another.

10. The invention of claim 9 wherein said distribution mechanism includes a plurality of conduits adapted to receive and conduct a flow of pressurized matter, each of said conduits adapted to conduct said matter to a different one of said discharge ports.

11. The invention of claim 9 wherein said toy gun includes a frame;

said frame incorporating a figurine;

said projectile discharge ports being located on said figurine.

12. The invention of claim 11 wherein said figurine simulates a vehicle.

13. The invention of claim 12 wherein said figurine simulates a flying vehicle having a plurality of wings, each of said wings carrying at least one of said discharge ports.

14. A toy gun comprising a frame, a plurality of discharge ports, a pump mechanism for pressurizing matter, a distribution mechanism for conducting matter pressurized by said pump to said projectile discharge ports, and a sequencing mechanism for controlling said distribution mechanism to direct said matter to said discharge ports in a predetermined sequence;

said frame incorporating a figurine having a plurality of extremities for carrying said projectile discharge ports, each of said extremities carrying at least one of said discharge ports.

15. The invention of claim 14 including a handle carried on said frame for general manipulation and carrying of the toy by a user, and a trigger to allow a user to selectively discharge projectile matter from said gun.

16. The invention of claim 14 wherein said pump mechanism includes a cylinder and a plunger, said plunger movably carried for pressurizing matter within said cylinder;

said distribution mechanism including a plurality of conduits, each of said conduits being in fluid communication with an individual one of said discharge ports;

said distribution mechanism further including an outlet for conducting pressurized matter from said cylinder, said outlet being movably carried for selective alignment with each of said conduits.

17. The invention of claim 16 wherein said pump mechanism is adapted to have an operational cycle including an intake stroke and a discharge stroke, said pump mechanism adapted to draw liquid from a reservoir into said cylinder on said intake stroke and to discharge pressurized liquid from said cylinder through said outlet on said discharge stroke;

each of said discharge ports including a nozzle such that pressurized liquid discharged from said cylinder and conducted through a selected conduit to one of said ports is discharged as a high pressure stream.

18. The invention of claim 17 including indexing surfaces on said cylinder, said cylinder rotatable about an axis to facilitate selective alignment of said outlet with said conduits;

said plunger including an indexing drive member cooperatively engaged with said indexing surfaces to cause incremental rotation of said cylinder whereby said outlet is sequentially aligned with successive conduits for successive operational cycles of said pump mechanism.

19. The invention of claim 16 including indexing surfaces on said cylinder, said cylinder rotatable about an axis to facilitate selective alignment of said outlet with said conduits;

an indexing drive mechanism cooperating with said indexing surfaces and having an operational cycle adapted to cause incremental rotation of said cylinder whereby said outlet is sequentially aligned with successive conduits for successive operational cycles of said indexing drive mechanism.

20. The invention of claim 19 wherein said indexing drive mechanism includes a user operable handle movably carried on said frame, operative travel of said handle inducing said incremental rotation of said cylinder.

21. The invention of claim 20 wherein said handle cooperates with said plunger to move said plunger from a first position to a second position to load matter into said cylinder in preparation for discharge therefrom.

22. The invention of claim 21 including a latch, a spring, and a user operable trigger;

said latch releasably retaining said plunger in said second position, and said spring biasing said plunger from said second position toward said first position;

said trigger operable by a user to release said plunger from said latch whereby said spring is allowed to drive said plunger from said second position to said first position to discharge pressurized matter from said cylinder.

23. The invention of claim 22 wherein each of said discharge ports includes a barrel adapted to carry a projectile such that pressurized matter discharged from said cylinder and conducted through a selected conduit to one of said ports causes a projectile carried by said barrel to be ejected.

24. The invention of claim 23 wherein said matter is air.

25. A toy gun comprising a pump for pressurizing matter, a distribution mechanism for selectively supplying matter pressurized by said pump to a plurality of discharge ports, a sequencing mechanism for causing said distribution mechanism to select individual said discharge ports in a predetermined sequence for application of pressurized matter thereto, said distribution and sequencing mechanisms including a conduit movably carried for rotation about an axis, said conduit being separate and distinct from said pump, said conduit including an outlet radially offset from said axis, said distribution mechanism including a plurality of passages in communication with said discharge ports, said passages positioned such that rotation of said conduit causes said outlet to sequentially become aligned with sequential said passages for transmission of pressurized matter thereto.

26. The invention of claim 25 including means for conducting matter pressurized by said pump to said movably carried conduit.

27. The invention of claim 26 including a user controllable operating mechanism for causing discharge of matter from said toy gun, said sequencing mechanism being actuated by said operating mechanism.

28. The invention of claim 27 wherein said operating mechanism includes a trigger assembly, said trigger assembly including a sequencing drive member adapted to cooperate with elements of said sequencing mechanism to translate operative motion of said trigger assembly into incremental rotation of said conduit and said offset outlet.

29. The invention of claim 28 wherein said trigger assembly is carried for reciprocating linear travel on said toy gun;

said toy gun including a mechanism for translating linear motion of said trigger into rotation of said conduit and said offset outlet.

30. A toy gun comprising a pump mechanism, a distribution mechanism, a sequencing mechanism, and a plurality of non-movable discharge ports adapted for projection of matter from said gun;

said discharge ports being fixed in position on said gun at locations that are remote with respect to said pump mechanism;

said pump mechanism adapted to pressurize matter;

said distribution mechanism adapted to receive pressurized matter and to selectively apply said matter to said remotely located discharge ports for discharge of said matter therefrom;

said sequencing mechanism controlling said distribution mechanism for selection of said discharge ports in a predetermined sequence;

said toy gun further comprising a handle assembly, said handle assembly being carried for reciprocative travel through a range of motion on said toy gun and including a handle accessible to a user for manipulation thereof;

said handle assembly further including a sequencing drive member adapted to cooperate with elements of said sequencing mechanism to incrementally advance said distribution mechanism through said predetermined sequence of discharge port selection in response to reciprocative cycling of said handle, whereby a reciprocation of said handle through its full range of motion causes said distribution mechanism to advance in said predetermined sequence of discharge port selection by one incremental step thereof, and whereby multiple such reciprocations of said handle are necessary to advance said distribution mechanism through the entirety of said predetermined sequence of discharge port selection.

31. The invention of claim 30 wherein said pump mechanism includes a plunger movably carried for pressurizing matter within a cylinder;

said plunger drawing matter into said cylinder for travel of said plunger from a first position to a second position, said plunger pressurizing matter within said cylinder for travel from said second position to said first position;

said handle assembly cooperating with said pump mechanism such that operative travel of said handle assembly through at least a portion of its reciprocative cycle causes said plunger to travel from said first position to said second position.

32. The invention of claim 31 including a latch for retaining said plunger in said second position, a spring biasing said plunger from said second position toward said first position, and a trigger for releasing said plunger from said latch whereby said spring is allowed to drive said plunger toward said first position to pressurize matter within said cylinder.

33. The invention of claim 32 wherein each said discharge port includes a barrel adapted to carry a projectile.

34. The invention of claim 33 wherein said pump mechanism is adapted to pressurize air and said distribution mechanism is adapted to transmit pressurized air from said pump mechanism to a selected barrel to eject a projectile therefrom.

* * * * *